US005446953A

United States Patent [19]

LeFeber

[11] Patent Number: 5,446,953

[45] Date of Patent: Sep. 5, 1995

[54] ELASTIC APPARATUS FOR RESTRAINING ARTICLES

[75] Inventor: Richard J. LeFeber, Cattaraugus, N.Y.

[73] Assignee: Chase Hunter Group, Cattaraugus, N.Y.

[21] Appl. No.: 195,928

[22] Filed: Feb. 14, 1994

[51] Int. Cl.[6] ..... A44B 21/00

[52] U.S. Cl. ..... 24/3.2; 24/17 B; 24/339; 224/222

[58] Field of Search ..... 224/148, 219, 222, 267, 224/312; 24/3 R, 3 A, 3 E, 17 B, 339, 335

[56] References Cited

U.S. PATENT DOCUMENTS

| | | | |
|---|---|---|---|
| 1,482,647 | 2/1924 | Gise | 224/219 X |
| 3,577,604 | 5/1971 | Brosk | 24/339 |
| 3,629,867 | 12/1971 | Taylor | 224/219 X |
| 3,823,814 | 7/1974 | Lum | 24/339 X |
| 4,733,808 | 3/1988 | Turner, Jr. et al. | 224/219 |
| 5,154,506 | 10/1992 | Lewd | 224/222 X |
| 5,302,302 | 4/1994 | Shelley et al. | 224/148 |

*Primary Examiner*—James R. Brittain
*Attorney, Agent, or Firm*—Howard J. Greenwald

[57] ABSTRACT

An integral apparatus for retaining an article which contains an elastic band with a proximal end, a distal end, a first major loop, a first minor loop, and a second minor loop. At a first point between the proximal end and the distal end, the elastic band is folded onto itself to form a first lip with a first top section and a first bottom section. At a second point between the distal end and the proximal end, the elastic band is folded onto itself to form a second lip with a second top section and a second bottom section. At a third point, the second top section, the first top section, and the first bottom section are sewn together. At a fourth point between the second point and the distal end, the second top section, the second bottom section, and the first bottom section are sewn together.

19 Claims, 2 Drawing Sheets

ELASTIC APPARATUS FOR RESTRAINING ARTICLES

FIELD OF THE INVENTION

An elastic band adapted to be attached to a support surface and to grasp various articles.

BACKGROUND OF THE INVENTION

Automobile sun visors which come as standard factory equipment usually are not adapted to hold to removably secure small articles, such as pens, pencils, small flashlights, and the like. Thus, drivers frequently attach a rubber band to such a visor. Alternatively, substantially U-shaped metal clips are often used.

None of the prior art devices for removably attaching small objects to a car's sun visor are totally satisfactory. In the first place, many of such devices either do not possess sufficient structural strength and/or lose a substantial amount of structural strength with age. In the second place, it is often difficult to insert and/or remove a small object into or from such devices. In the third place, many of such devices can only retain one object at a time. In the fourth place, many of such devices are not adapted to receive and display advertising messages. In the fifth place, many of such devices cannot readily be mounted and/or removed from the sun visor.

It is an object of this invention to provide an elastic band adapted to be removably attached to a support surface which possesses durable mechanical properties.

It is another object of this invention to provide an elastic band adapted to be removably attached to a support surface which can retain at least two articles simultaneously.

It is yet another object of this invention to provide an elastic band adapted to be removably attached to a support surface whose surface(s) can be permanently printed with various indicia.

It is yet another object of this invention to provide an elastic band adapted to be removably attached to a support surface wherein said band is comprised of a portion containing three layers of elastic material joined together.

SUMMARY OF THE INVENTION

In accordance with this invention, there is provided an integral elastic structure comprised of a first loop section integrally joined to a second loop section and to a third loop section. At the point at which the first loop section is joined to the second loop section, and also at the point the first loop section is joined to the third loop section, at least three layers of elastic band material are sewn together.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 1:
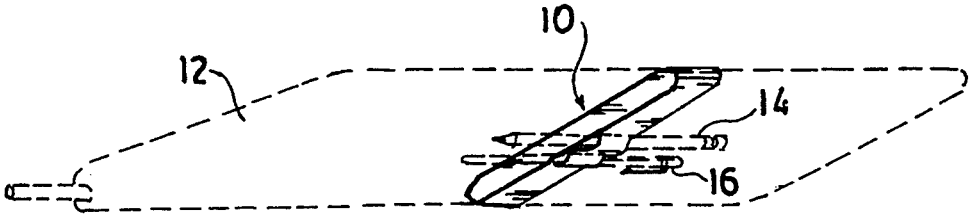
FIG. 1 is a perspective view of one preferred embodiment of ting device of this invention shown attached to sun visor.

Applicant's elastic apparatus 10 is especially useful for restraining articles within a car. Thus, referring to FIG. 1, it will be seen that apparatus 10 may be removably attached to sun visor 12 and, when so attached, may be used to removably secure pencil 14 and pen 16.

One of the advantages of applicant's elastic apparatus 10 is that it can contain indicia, such as indicia 18 (see FIG. 2), permanently printed on it. Consequently, because of this feature and the relatively inexpensive cost of apparatus 10, such apparatus 10 may be used as an advertising novelty.

In one preferred embodiment, indicia 18 (or other suitable indicia) are affixed to elastic apparatus 10 by heat transfer printing. This printing process is well known to those skilled in the art and is described in, e.g., U.S. Pat. Nos. 5,106,694, 5,100,718, 5,082,730, 4,893,556, 4,842,613, 4,758,952, 4,636,223, 4,365,966, 4,226,594, 4,110,070, 4,038,123, and the like. The disclosure of each of these United States patents is hereby incorporated by reference into this specification.

In one preferred embodiment, elastic apparatus 10 is printed by a heat transfer process in which the indicia are first transferred to a heat transfer sheet which, in turn, are then used to print the elastic material (see, e.g., U.S. Pat. No. 5,106,694).

Referring again to FIG. 2, it will be seen that elastic apparatus 10 is joined at points 20 and 22 by stitching which extends through at least three layers of elastic material. This feature will be shown in more detail in FIG. 3.

Figure 3:
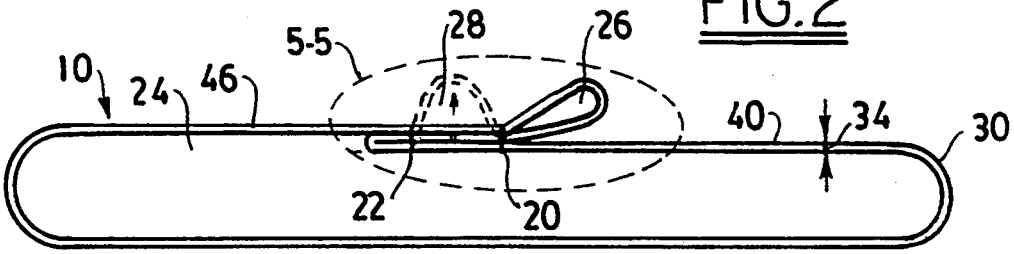
FIG. 3 is a side view of the mounting device of FIG. 1.
Figure 4:
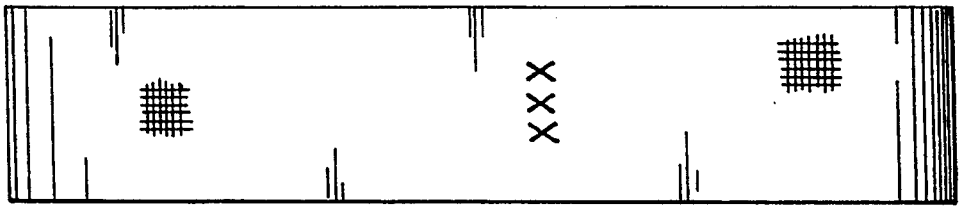
FIG. 4 is a bottom view of the mounting device of FIG. 1.

Referring to FIG. 3, it will be seen that elastic apparatus 10 is an integral structure which is comprised of a first major loop 24, a second minor loop 26, and a third minor loop 28. Each of these loops is preferably formed by stitching an elastic band 30 together at points 20 and 22 so that at least three layers of said band are joined to each other at each of such points.

Any of the elastic bands and/or the elastic fabric materials known to those skilled in the art may be used in the process of this invention. Thus, by way of illustration and not limitation, one may use the devices and/or processes disclosed in U.S. Pat. Nos. 5,075,902 (elastic fabric belt material), 5,075,142 (elastic fabric), 5,056,247 (elastic band), 5,038,776 (elastic fabric), 5,036,549 (elastic band), 5,014,403 (elastic yarn), 5,002,381 (fabric covered elastic foam), 4,998,421 (elastic thread), 4,998,419 (contractible elastic yarn), 4,972,522 (elastic fabric), 4,970,728 (flat elastic strip), 4,961,232 (elastic fabric), 4,909,049 (bioelastic warp-knit fabric), 4,891,040 (elastic yarns), 4,879,169 (elastic quilted composite fabric), and the like. The disclosure of each of these United States patents is hereby incorporated by reference into this specification.

Figure 2:
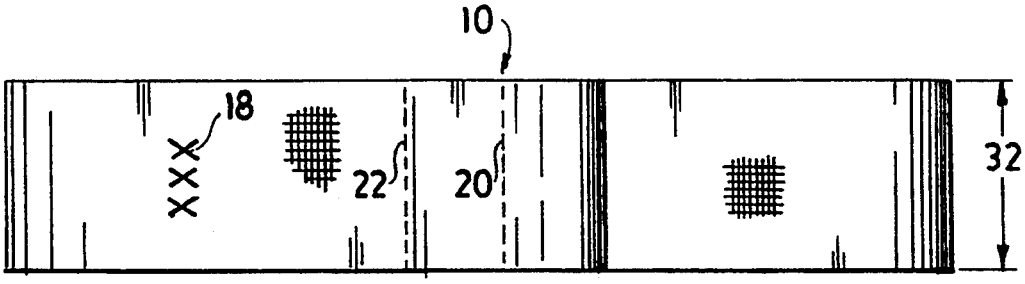
FIG. 2 is a top view of the mounting device of FIG. 1.

In one preferred embodiment, and referring to FIG. 2, elastic apparatus 10 has a width 32 of from about 0.25 to about 3.0 inches and, preferably, from about 0.75 to about 1.25 inches. In an especially preferred embodiment, width 32 is from about 0.9 to about 1.1 inches.

Referring again to FIG. 3, and in the preferred embodiment illustrated therein, it will be seen that elastic band 30 preferably has a thickness 34 of less than about 0.13 inches and generally ranges from about 0.03 to about 0.12 inches.

It is preferred that elastic band 30 be comprised of at least about 60 weight percent of a synthetic fiber material. As is known to those skilled in the art, synthetic fibers can be based upon natural organic polymers, such as rayon (regenerated cellulose), acetate (partially acetylated cellulose derivative), triacetate (fully acetylated cellulose derivative), azlon (regenerated protein), and the like. It is preferred, however, that the synthetic fiber be based upon synthetic organic polymers, such as acrylic (polyacrylonitrile), aramid (aromatic polyamides), nylon (aliphatic polyamides), olefin (polyolefins), polyester (polyesters of an aromatic dicarboxylic acid and a dihydric alcohol), spandex (segmented polyrethane), vinyon (polyvinyl chloride), and the like. See, e.g., pages 219 et seq. of "Polymers: Fibers and Textiles, A Compendium," edited by Jacqueline I. Kroschwitz (John Wiley & Sons, New York, 1990).

In one preferred embodiment, elastic band 30 contains at least about 65 weight percent of poly(ethylene terephthalate) which, preferably, is a textured polyester. In an especially preferred embodiment, elastic band 30 contains at least about 70 weight percent of said polyester material.

In addition to said synthetic fiber material, elastic band 30 also contains at least about 20 weight percent of an elastomeric fiber. As is known to those skilled in the art, elastomeric fibers consist of polymers with a main glass transition temperature well below room temperatures and, thus, include polyisoprenes (natural rubber), segmented polyurethane (spandex), and the like.

In one preferred embodiment, elastic band 30 has an elongation of from about 50 to about 90 percent and, preferably, from about 55 to about 85 percent. In one especially preferred embodiment, the elongation of band 30 is from about 65 to about 75 percent.

The elongation of band 30 may be measured by a test in which a 5.0 inch long segment of band 30 is marked, and the band 30 is then stretched to its maximum to determine the maximum length possible. Every 0.5" in length of the stretched 5.0 inch marked segment in excess of 5.0 inches is deemed to be equivalent to 10 percent of elongation; thus, e.g., if the 5.0 segment is able to be stretched to 7.0 inches, it has an elongation of 40%.

In one preferred embodiment, the elastic band 30 has a width of 1.0 inch, plus or minus 1/16th of an inch. It consists essentially of 132 ends of 2/150 textured polyester warp fiber, 1 end of 1/150 textured polyester filling fiber, and 23 ends of 40 gauge natural latex rubber; it has an elongation of 70 plus or minus 10 percent; and it contains 76 weight percent of polyester and 24 weight percent of natural rubber. Such an elastic band material may be obtained as product BPT-16 from the Southern Webbing Company of 4701 Southern Webbing Mills Road, Greensboro, N.C. 27405.

Referring again to FIG. 2, and in the preferred embodiment illustrated therein, it is preferred that the thread used to stitch together apparatus 10 be a nylon monofilament thread which is substantially transparent. Such a thread may be obtained, e.g., from the S.M. Crystal Company of 775 Main Street, Buffalo, N.Y. as product number 8301-21 (crystal clear thread).

Figure 5:
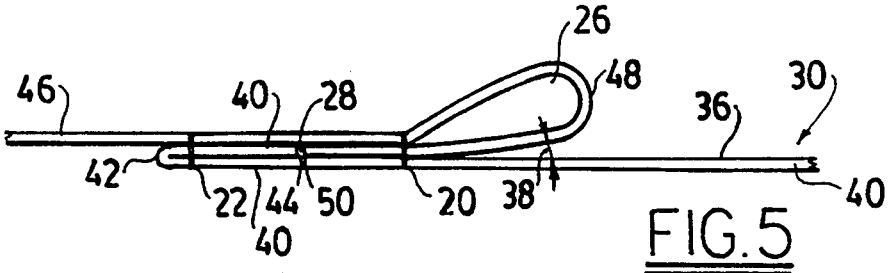
FIG. 5 is an enlarged side view of a portion the mounting device of FIG. 1.

Referring to FIGS. 2 and 5, and in the preferred embodiments illustrated therein, it will be seen that device 10 is comprised of a major loop 24 (which defines an area which is at least 60 percent of the volume of the total area of the loop 24, and loops 26 and 28), a first minor loop 26, and a second minor loop 28.

Referring again to FIGS. 2 and 5, it will be seen that major loop 24 is normally in an open position when elastic band 30 is not being deformed or otherwise subjected to stress. Similarly, first minor loop 26 is also in a normally open position when elastic band 30 is not being deformed or otherwise subjected to stress. By comparison, second minor loop 28 is normally in a substantially closed position when elastic band 30 is not being deformed or otherwise subjected to stress.

Referring again to FIGS. 2 and 5, it will also be seen that, in addition to being in a normally open position, minor loop 26 protrudes from the top surface 36 of band 30 so that it forms an angle 38 with such top surface of at least about ten degrees.

FIG. 5 is an enlarged, partial sectional view of a portion of FIG. 2, showing how various sections of elastic band 30 are joined together.

Referring to FIG. 5, it will be seen that section 40 of elastic band 30 forms the top right portion of loop 24. Section 40 extends to point 42, at which point it folds back upon itself and then extends in the other direction until point 44, at which points it terminates.

Referring again to FIG. 5, it will be seen that section 46 of elastic band 30 forms the top left portion of loop 24. Section 46 extends to point 22 (at which point it is joined to two portions of section 40), and past such point to point 20 (at which point it is joined to one portion of section 46 and one portion of section 40), and past such point to point 48, and which point it changes direction and extends to point 50, where it terminates.

In the embodiment illustrated in FIG. 5, the ends of sections 40 and 46 are not contiguous. In another embodiment, not shown, the ends of sections 40 and 46 are contiguous.

Thus, as will be apparent to those skilled in the art, elastic band 30 is comprised of two ends, each of which is folded back onto itself to form a double width section. Each such double width section is then joined to a single width section of one of the other ends to form structure 10.

In one preferred embodiment, not shown, the sections 40 and 46 are joined at points 22 and 20 by means of being sewn together by a lock stitch or a bar tack. It is preferred to use a ball point needle.

Figure 6:
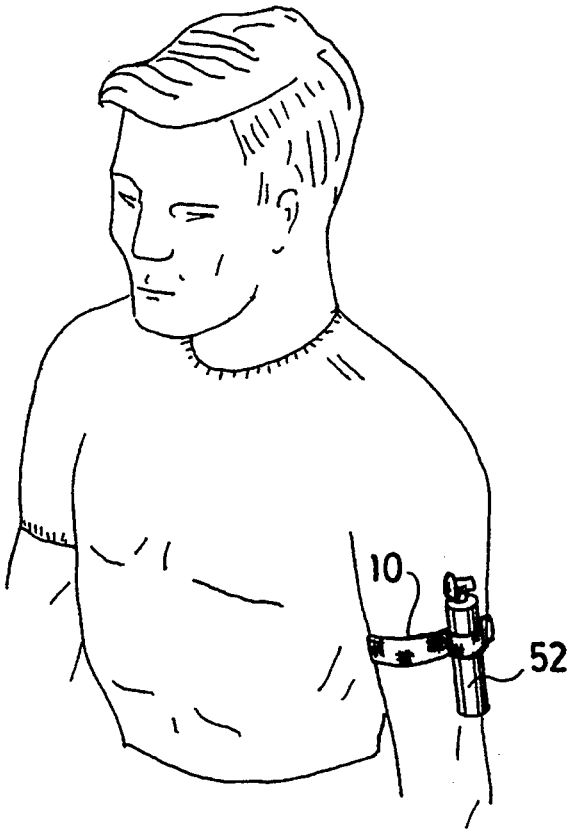
FIG. 6 is a perspective view of the device of FIG. 1, shown in use on a user's arm.

FIG. 6 illustrates one preferred use of the elastic device 10 of FIG. 1, which may be used to removably retain a protective spray container 52.

As is disclosed in U.S. Pat. No. 4,220,263, the disclosure of which is hereby incorporated by reference into this specification, the use of protective spray to ward off would be attackers has become more prevalent. The protective spray container usually is an aerosol can, and it often is carried in the purse of the pocket, places where it often is not readily accessible.

In one aspect of applicant's invention, illustrated in FIG. 6, a person may removably attach device 10 (which retains spray canister 52) to his arm or another part of his body so that he can readily gain access to it in an emergency. In another aspect of the invention, the protective spray canister 52 may be removably secured to device 10 which, in turn, may be attached to the sun visor of a car to assist in warding off car hijackings. Other uses will be apparent to those skilled in the art.

Figure 7:
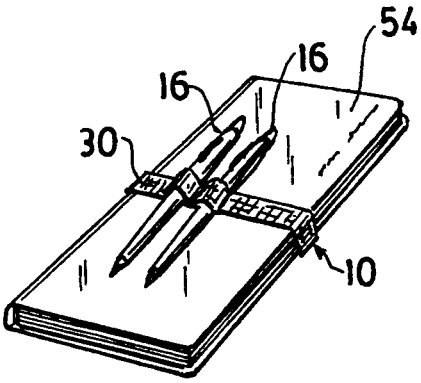
FIG. 7 is a perspective view of the device of FIG. 1, shown in use on a checkbook.

FIG. 7 is an illustration of another embodiment of the invention, in which mounting device 10 is attached to a checkbook 54.

Figure 8:
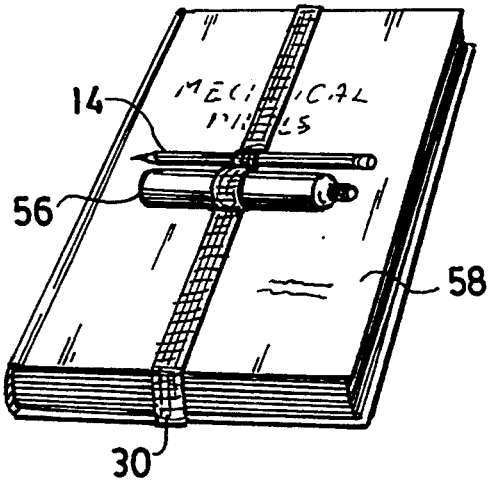
FIG. 8 is a perspective view of the device of FIG. 1, shown in use on a textbook.

FIG. 8 is an illustration of another embodiment of the invention, in which mounting device 10 is attached to a textbook 58 and retains a pencil 14 and a highlighting instrument 56. It will be apparent to those skilled in the art that the mounting device 10 may be used with other books (such as notebooks, and the like). It will also be apparent to those skilled in the art that device 10 may be used as a bookmark, and/or a noteholder. If the length of major loop 24 is increased, device 10 may be used to hold several books, files, maps, or other articles.

In another embodiment, not shown, device 10 may be worn in the manner illustrated in FIG. 6, and one more hooks may be removably attached through either minor loop 26 and/or minor loop 28 to secure one or more articles. In one embodiment, not shown, such hook(s) may be attached to ski ticket or other printed credential.

In another embodiment, not shown, device 10 may be worn as a headband and used to retain one or more pens, pencils, or similar devices within minor loops 26 and/or 28. In this embodiment, it is preferred that the stitching at points 20 and/or 22 be angled so that the devices retained within loops 26 and/or 28 are angularly disposed with respect to elastic band 30.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. An integral apparatus for retaining an article, comprising an elastic band comprised of a proximal end and a distal end, a first major loop, a first minor loop, and a second minor loop, wherein:

(a) at a first point intermediate said proximal end and said distal end, said elastic band is folded onto itself to form a first lip comprised of a first top section and a first bottom section, wherein said first top section terminates in said proximal end;

(b) at a second point intermediate said distal end and said proximal end, said elastic band is folded onto itself to form a second lip comprised of a second top section and a second bottom section, wherein said second bottom section terminates in said distal end;

(c) at a third point intermediate said first point and said proximal end, said second top section, said first top section, and said first bottom section are sewn together;

(d) at a fourth point intermediate said second point and said distal end, said second top section, said second bottom section, and said first bottom section are sewn together;

(e) said first major loop, said first minor loop, and said second minor loop are substantially coplanar.

2. The integral apparatus as recited in claim 1, wherein said apparatus is comprised of indicia printed on at least one of the surfaces thereof.

3. The integral apparatus as recited in claim 1, wherein said elastic band has a width of from about 0.9 to about 1.1 inches.

4. The integral apparatus as recited in claim 1, wherein said elastic band has a thickness of less than about 0.13 inches.

5. The integral apparatus as recited in claim 1, wherein said elastic band is comprised of at least about 60 weight percent of a synthetic fiber material.

6. The integral apparatus as recited in claim 5, wherein said synthetic fiber material consists essentially of synthetic organic polymeric material.

7. The integral apparatus as recited in claim 6, wherein said synthetic organic polymeric material is a polyester of an aromatic dicarboxylic acid and a dihydric alcohol.

8. The integral apparatus as recited in claim 7, wherein said polyester is poly (ethylene terephthalate).

9. The integral apparatus as recited in claim 1, wherein said elastic band is comprised of at least about 20 weight percent of an elastomeric fiber.

10. The integral apparatus as recited in claim 9, wherein said elastomeric fiber consists essentially of natural rubber.

11. The integral apparatus as recited in claim 1, wherein said elastic band has an elongation of from about 55 to about 85 percent.

12. The integral apparatus as recited in claim 1, wherein said second top section, said first top section, and said first bottom section are sewn together with a nylon monofilament thread.

13. The integral apparatus as recited in claim 1, wherein said second top section, said second bottom section, and said first bottom section are sewn together by nylon monofilament thread.

14. The integral apparatus as recited in claim 1, wherein said first minor loop extends diagonally from the top surface of said elastic band.

15. The integral apparatus as recited in claim 1, wherein said apparatus further comprises a protective spray container removably attached to one of said first minor loop and said second minor loop.

16. The integral apparatus as recited in claim 1, wherein said protective spray container comprises an actuating button and a nozzle for dispensing a spray for warding off an attacker.

17. The integral apparatus as recited in claim 1, wherein:

(a) said apparatus is comprised of indicia printed on at least one of the surfaces thereof, (b) said elastic band has a width of from about 0.9 to about 1.1 inches, (c) said elastic band has a thickness of less than about 0.13 inches, (d) said elastic band is comprised of at least about 60 weight percent of a synthetic fiber material.

18. The integral apparatus as recited in claim 17, wherein:

(a) said synthetic fiber material consists essentially wherein said synthetic organic polymeric material is a polyester of an aromatic dicarboxylic acid and a dihydric alcohol, and (b) said elastic band is comprised of at least about 20 weight percent of an elastomeric fiber.

19. The integral apparatus as recited in claim 17, wherein:

(a) said elastomeric fiber consists essentially of natural rubber, (b) said elastic band has an elongation of from about 55 to about 85 percent.

* * * * *